US011340001B2

(12) United States Patent
Ochiai et al.

(10) Patent No.: US 11,340,001 B2
(45) Date of Patent: May 24, 2022

(54) REFRIGERATION CYCLE APPARATUS

(71) Applicant: Mitsubishi Electric Corporation, Tokyo (JP)

(72) Inventors: Yasutaka Ochiai, Tokyo (JP); Haruo Nakano, Tokyo (JP); Hideki Tsukino, Tokyo (JP); Ryohei Horiba, Tokyo (JP); Yasuhiro Suzuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 13 days.

(21) Appl. No.: 16/478,876

(22) PCT Filed: Mar. 1, 2017

(86) PCT No.: PCT/JP2017/008139
§ 371 (c)(1),
(2) Date: Jul. 18, 2019

(87) PCT Pub. No.: WO2018/158886
PCT Pub. Date: Sep. 7, 2018

(65) Prior Publication Data
US 2019/0383533 A1 Dec. 19, 2019

(51) Int. Cl.
*F25B 49/02* (2006.01)
*F25B 41/20* (2021.01)

(52) U.S. Cl.
CPC ..... *F25B 41/20* (2021.01); *F25B 49/02* (2013.01); *F25B 2500/222* (2013.01); *F25B 2600/2513* (2013.01)

(58) Field of Classification Search
CPC ..... F25B 49/02; F25B 2500/222; F25B 2600/2513; F25B 41/20
See application file for complete search history.

(56) References Cited

U.S. PATENT DOCUMENTS

2010/0198416 A1* 8/2010 Kasahara ..... F25B 49/02 700/282
2013/0233006 A1 9/2013 Morimoto et al.

FOREIGN PATENT DOCUMENTS

JP H07-248164 A 9/1995
JP 2005-321194 A 11/2005
(Continued)

OTHER PUBLICATIONS

International Search Report of the International Searching Authority dated May 16, 2017 for the corresponding International application No. PCT/JP2017/008139 (and English translation).
(Continued)

*Primary Examiner* — Elizabeth J Martin
*Assistant Examiner* — Nael N Babaa
(74) *Attorney, Agent, or Firm* — Posz Law Group, PLC

(57) ABSTRACT

A refrigeration cycle apparatus includes a refrigeration cycle circuit, a liquid receiver, a first valve and a second valve. The refrigeration cycle circuit includes a compressor, an outdoor heat exchanger and an indoor heat exchanger. The liquid receiver is provided in a second section located in the refrigeration cycle circuit. The second section is a section extending between the outdoor heat exchanger and the indoor heat exchanger without extending through the compressor. The first valve is provided in a first section in the refrigeration cycle circuit, and is a solenoid valve or a motor valve. The first section is a section extending between the outdoor heat exchanger and the indoor heat exchanger through the compressor. The second valve is provided in the second section and between the liquid receiver and the indoor heat exchanger, and is an electronic expansion valve, a solenoid valve or a motor valve.

4 Claims, 4 Drawing Sheets

(56) References Cited

FOREIGN PATENT DOCUMENTS

| | | | | | |
|---|---|---|---|---|---|
| JP | 2013-167398 | A | | 8/2013 | |
| JP | 2013167398 | A | * | 8/2013 | |
| WO | 2004/005060 | A1 | | 1/2004 | |
| WO | 2012/101673 | A1 | | 8/2012 | |
| WO | WO-2012101673 | A1 | * | 8/2012 | ..... F25B 9/008 |
| WO | 2015/198489 | A1 | | 12/2015 | |

OTHER PUBLICATIONS

Extended European Search Report dated Mar. 13, 2020 for the corresponding EP application No. 17898433.2.
Office Action dated Sep. 3, 2020 issued in corresponding CN patent application No. 201780087224.2 (and English translation).

* cited by examiner

REFRIGERATION CYCLE APPARATUS

CROSS REFERENCE TO RELATED APPLICATION

This application is a U.S. national stage application of PCT/JP2017/008139 filed on Mar. 1, 2017, the contents of which are incorporated herein by reference.

TECHNICAL FIELD

The present invention relates to a refrigeration cycle apparatus provided with a liquid receiver.

BACKGROUND ART

Patent literature 1 discloses a refrigeration cycle apparatus. The refrigeration cycle apparatus includes a liquid level detection sensor configured to detect the amount of liquid refrigerant in a liquid reservoir, and a refrigerant leakage detecting device configured to compare with a reference value, a value corresponding to the amount of liquid refrigerant in the liquid reservoir which is detected by the liquid level detection sensor when a predetermined time period elapses from time when a compressor is stopped, and determine whether refrigerant leaks from a refrigerant circuit based on the above comparison.

CITATION LIST

Patent Literature

Patent Literature 1: International Publication No. WO 2015/198489

SUMMARY OF INVENTION

Technical Problem

However, there is a case where the above refrigeration cycle apparatus cannot detect refrigerant leakage which occurs while the compressor is in the stopped state. Therefore, if refrigerant leaks from an indoor heat exchanger while the compressor is in the stopped state, it may enter a room.

The present invention has been made to solve the above problem, and an object of the invention is to provide a refrigeration cycle apparatus that can reduce, even if refrigerant leaks from an indoor heat exchanger while the compressor is in the stopped state, the amount of the refrigerant leaking from the indoor heat exchanger.

Solution to Problem

A refrigeration cycle apparatus according to an embodiment of the present invention includes: a refrigeration cycle circuit including a compressor, an outdoor heat exchanger and an indoor heat exchanger; a liquid receiver provided in a second section of a plurality of sections located in the refrigeration cycle circuit, the plurality of sections including a first section and the second section, the first section being a section extending between the outdoor heat exchanger and the indoor heat exchanger through the compressor, the second section being a section extending between the outdoor heat exchanger and the indoor heat exchanger without extending through the compressor; a first valve provided in the first section, the first valve being a solenoid valve or a motor valve; and a second valve provided in the second section and between the liquid receiver and the indoor heat exchanger, the second valve being an electronic expansion valve, a solenoid valve or a motor valve.

Advantageous Effects of Invention

Accounting to the embodiment of the present invention, after the compressor is stopped, in the refrigeration cycle circuit, the liquid receiver can be cut off by the first and the second valves from the indoor heat exchanger. Therefore, even if refrigerant leaks from the indoor heat exchanger while the compressor is in the stopped state, it is possible to reduce the amount of refrigerant leakage from the indoor heat exchanger.

DESCRIPTION OF EMBODIMENTS

Embodiment 1

Figure 1:
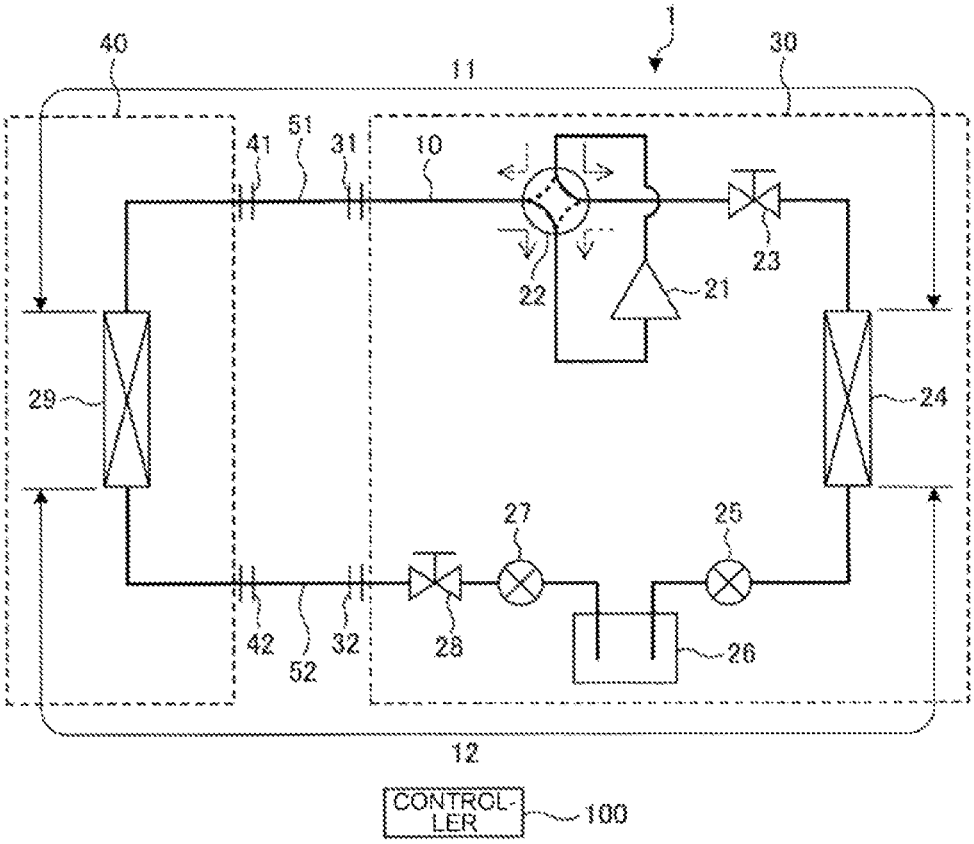
FIG. 1 is a refrigerant circuit diagram illustrating a schematic configuration of a refrigeration cycle apparatus 1 according to embodiment 1 of the present invention.

A refrigeration cycle apparatus according to embodiment 1 of the present invention will be described. FIG. 1 is a refrigerant circuit diagram illustrating a schematic configuration of the refrigeration cycle apparatus 1 according to the present embodiment. In embodiment 1, an air-conditioning apparatus is provided as an example of a refrigeration cycle apparatus 1.

As illustrated in FIG. 1, the refrigeration cycle apparatus 1 includes a refrigeration cycle circuit 10 provided to circulate refrigerant. In the refrigeration cycle circuit 10, a compressor 21, a refrigerant flow switching device 22, a solenoid valve 23 (an example of a first valve), an outdoor heat exchanger 24, an expansion valve 25, a liquid receiver 26 (receiver), an expansion valve 27, a solenoid valve 28 (an example of a second valve) and an indoor heat exchanger 29 are sequentially connected by refrigerant pipes. The refrigeration cycle circuit 10 can switch the operation to be performed between a cooling operation and a heating operation, and perform one of the cooling operation and the heating operation, which is selected by the above switching.

In the cooling operation, the outdoor heat exchanger 24 operates as a condenser, and in the heating operation, the outdoor heat exchanger 24 operates as an evaporator. However, the refrigeration cycle circuit 10 may be configured to perform only one of the cooling operation and the heating operation. As a matter of convenience for explanation, a section extending between the outdoor heat exchanger 24 and the indoor heat exchanger 29 through the compressor 21 in the refrigeration cycle circuit 10 will be referred to as a first section 11, and a section extending between the outdoor heat exchanger 24 and the indoor heat exchanger 29 without extending through the compressor 21 in the refrigeration cycle circuit 10 will be referred to as a second section 12.

Furthermore, the refrigeration cycle apparatus 1 includes an outdoor unit 30 which is installed, for example, outdoors and an indoor unit 40 which is installed, for example, indoors. In the outdoor unit 30, at least the outdoor heat exchanger 24 is provided. In addition to the outdoor heat exchanger 24, in the outdoor unit 30 of embodiment 1, the compressor 21, the refrigerant flow switching device 22, the solenoid valve 23, the expansion valve 25, the liquid receiver 26, the expansion valve 27 and the solenoid valve 28 are provided. In the indoor unit 40, at least the indoor heat exchanger 29 is provided.

The outdoor unit 30 and the indoor unit 40 are connected by an extension pipe 51 (gas pipe) and an extension pipe 52 (liquid pipe), which are part of the refrigerant pipes. One of ends of the extension pipe 51 is connected to the outdoor unit 30 through a joint 31, and the other is connected to the indoor unit 40 through a joint 41. One of ends of the extension pipe 52 is connected to the outdoor unit 30 through a joint 32, and the other is connected to the indoor unit 40 through a joint 42.

The compressor 21 is a fluid machine that sucks and compresses low-pressure gas refrigerant into high-pressure gas refrigerant, and discharge the high-pressure gas refrigerant. The refrigerant flow switching device 22 switches the flow direction of refrigerant in the refrigeration cycle circuit 10 between that for the cooling operation and that for the heating operation. As the refrigerant flow switching device 22, for example, a four-way valve, is used.

The solenoid valve 23 (an example of the first valve) is a valve which is opened and closed under control by a controller 100 which will be described later. For example, the solenoid valve 23 is kept in the opened state while the compressor 21 is in operation. The solenoid valve 23 is provided in the first section 11 of the refrigeration cycle circuit 10. Preferably, in the first section 11, the solenoid valve 23 should be provided between the joint 41 located close to the indoor unit 40 and the outdoor heat exchanger 24, and more preferably, the solenoid valve 23 should be provided between the joint 31 located closed to the outdoor unit 30 and the outdoor heat exchanger 24 (that is, it should be provided in the outdoor unit 30). The solenoid valve 23 of embodiment 1 is provided in the outdoor unit 30 and between the refrigerant flow switching device 22 and the outdoor heat exchanger 24 in the first section 11. In embodiment 1, although the solenoid valve 23 is used as the first valve, a motor valve that is opened and closed under control by the controller 100 can also be used as the first valve.

The outdoor heat exchanger 24 operates as a radiator (for example, a condenser) during the cooling operation and as an evaporator during the heating operation. In the outdoor heat exchanger 24, heat is exchanged between refrigerant flowing in the outdoor heat exchanger 24 and outdoor air sent by an outdoor fan (not illustrated).

The liquid receiver 26 stores surplus refrigerant that remains because of changes in operating conditions including switching between the cooling operation and the heating operation. The liquid receiver 26 is provided in the second section 12 of the refrigeration cycle circuit 10.

Each of the expansion valves 25 and 27 reduces the pressure of the refrigerant. The expansion valve 25 is located between the outdoor heat exchanger 24 and the liquid receiver 26 in the second section 12 of the refrigeration cycle circuit 10. The expansion valve 27 is located between the liquid receiver 26 and the indoor heat exchanger 29 in the second section 12 of the refrigeration cycle circuit 10. Each of the expansion valves 25 and 27 is an electronic expansion valve whose opening degree is adjustable by the controller 100 which will be described later.

The solenoid valve 28 (an example of the second valve) is opened and closed under control by the controller 100. For example, the solenoid valve 28 is kept in the opened state while the compressor 21 is in operation. The solenoid valve 28 is located between the liquid receiver 26 and the indoor heat exchanger 29 in the second section 12 of the refrigeration cycle circuit 10. In the second section 12, preferably, the solenoid valve 28 should be provided between the liquid receiver 26 and the joint 42 located close to the indoor unit 40, and more preferably, it should be provided between the liquid receiver 26 and the joint 32 located close to the outdoor unit 30 (that is, it should be provided in the outdoor unit 30). The solenoid valve 28 of embodiment 1 is provided between the liquid receiver 26 and the joint 32 in the second section 12. In embodiment 1, although the solenoid valve 28 is used as the second valve, a motor valve or an electronic expansion valve that is opened and closed under control by the controller 100 may also be used as the second valve.

The indoor heat exchanger 29 operates as an evaporator during the cooling operation and as a radiator (for example, a condenser) during the heating operation. In the indoor heat exchanger 29, heat is exchanged between refrigerant flowing in the indoor heat exchanger 29 and indoor air sent by an indoor fan (not illustrated).

As the refrigerant to be circulated in the refrigeration cycle circuit 10, for example, a flammable refrigerant is used. In this case, the flammable refrigerant means refrigerant having a flammability level (for example, class 2L and above as classified under ASHRAE Standard 34) higher than or equal to a flammability level of slightly flammable refrigerant (which is, for example, class 2L and above as classified under ASHRAE Standard 34). Alternatively, as the refrigerant to be circulated in the refrigeration cycle circuit 10, a nonflammable refrigerant or a toxic refrigerant may be used.

The controller 100 includes a microcomputer including a CPU, a ROM, a RAM, an I/O port, etc. Based on signals such as detection signals from various sensors provided in the refrigeration cycle circuit 10 and an operations signal from an operation unit, the controller 100 controls the operation of the entire refrigeration cycle apparatus 1, which includes operations of the compressor 21, the refrigerant flow switching device 22, the solenoid valves 23 and 28 and the expansion valves 25 and 27. The controller 100 may be provided in either the outdoor unit 30 or the indoor unit 40. The controller 100 may further include an outdoor-unit control unit provided in the outdoor unit 30, and an indoor-unit control unit provided in the indoor unit 40 and capable of communicating with the outdoor-unit control unit.

Next, the operation of the refrigeration cycle apparatus 1 will be described. First of all, it will be described how the refrigeration cycle apparatus 1 is operated during the cooling operation. In FIG. 1, solid arrows indicate flow directions of the refrigerant during the cooling operation. During the cooling operation, in the refrigeration cycle circuit 10, a refrigerant flow passage to be used is changed by the refrigerant flow switching device 22 in a switching manner to thereby cause high-pressure refrigerant discharged from the compressor 21 to flow into the outdoor heat exchanger 24.

To be more specific, high-temperature and high-pressure gas refrigerant discharged from the compressor 21 flows through the refrigerant flow switching device 22 and the solenoid valve 23 being in the opened state to enter the outdoor heat exchanger 24. During the cooling operation, the outdoor heat exchanger 24 operates as a condenser. To be more specific, in the outdoor heat exchanger 24, heat is exchanged between the refrigerant flowing in the outdoor heat exchanger 24 and outdoor air sent by the outdoor fan, and the heat of condensation of the refrigerant is transferred to the outdoor air. The refrigerant having entered the outdoor heat exchanger 24 is thus condensed to change into high-pressure liquid refrigerant. After flowing out of the outdoor heat exchanger 24, the high-pressure liquid refrigerant is reduced in pressure in the expansion valve 25 to change into intermediate-pressure liquid refrigerant. Then, the intermediate-pressure liquid refrigerant flows into the liquid receiver 26.

After flowing out of the liquid receiver 26, the liquid refrigerant is further reduced in pressure in the expansion valve 27 to change into low-pressure two-phase refrigerant. After flowing out of the expansion valve 27, the low-pressure two-phase refrigerant flows through the open solenoid valve 28 being in the opened state and the extension pipe 52 to enter the indoor heat exchanger 29 of the indoor unit 40. During the cooling operation, the indoor heat exchanger 29 operates as an evaporator. To be more specific, in the indoor heat exchanger 29, heat is exchanged between the refrigerant flowing in the indoor heat exchanger 29 and indoor air sent by the indoor fan, and heat is received from the indoor air as the heat of evaporation of the refrigerant. As a result, the refrigerant in the indoor heat exchanger 29 evaporates to change into low-pressure gas refrigerant or high-quality two-phase refrigerant. Also, the air sent by the indoor fan is cooled as its heat is received by the refrigerant. After flowing out of the indoor heat exchanger 29, the low-pressure gas refrigerant or two-phase refrigerant flows through the extension pipe 51 and the refrigerant flow switching device 22, and is then sucked into the compressor 21. The refrigerant sucked into the compressor 21 is compressed into high-temperature and high-pressure gas refrigerant. During the cooling operation, the above cycle is continuously repeated.

Next, it will be described how the refrigeration cycle apparatus 1 is operated during the heating operation. In FIG. 1, dashed arrows indicate flow directions of the refrigerant during the heating operation. During the heating operation, in the refrigeration cycle circuit 10, the refrigerant flow switching device 22 changes the refrigerant flow passage to be used, in a switching manner, to thereby cause high-pressure refrigerant discharged from the compressor 21 to flow into the indoor heat exchanger 29.

The high-temperature and high-pressure gas refrigerant discharged from the compressor 21 flows through the refrigerant flow switching device 22 and the extension pipe 51 to enter the indoor heat exchanger 29 of the indoor unit 40. During the heating operation, the indoor heat exchanger 29 operates as a condenser. To be more specific, in the indoor heat exchanger 29, heat is exchanged between the refrigerant flowing in the indoor heat exchanger 29 and indoor air sent by the indoor fan, and the heat of condensation of refrigerant is transferred to the indoor air. The refrigerant having entered the indoor heat exchanger 29 is thus condensed to change into high-pressure liquid refrigerant. Also, the indoor air sent by the indoor fan is heated by the heat transferred from the refrigerant. After flowing out of the indoor heat exchanger 29, the high-pressure liquid refrigerant flows through the extension pipe 52 and the solenoid valve 28 being in the opened state to the expansion valve 27. In the expansion valve 27, the liquid refrigerant is reduced in pressure to change into intermediate-pressure liquid refrigerant, and the intermediate-pressure liquid refrigerant flows into the liquid receiver 26.

After flowing out of the liquid receiver 26, the liquid refrigerant is further reduced in pressure in the expansion valve 25 to change into low-pressure two-phase refrigerant. After flowing out of the expansion valve 25, the low-pressure two-phase refrigerant flows into the outdoor heat exchanger 24. During the heating operation, the outdoor heat exchanger 24 operates as an evaporator. To be more specific, in the outdoor heat exchanger 24, heat is exchanged between the refrigerant flowing in the outdoor heat exchanger 24 and outdoor air sent by the outdoor fan, and heat is received from the outdoor air as the heat of evaporation of the refrigerant. As a result, the refrigerant in the outdoor heat exchanger 24 evaporates to change into low-pressure gas refrigerant or high-quality two-phase refrigerant. After flowing out of the outdoor heat exchanger 24, the low-pressure gas refrigerant or two-phase refrigerant flows through the solenoid valve 23 being in the opened state and the refrigerant flow switching device 22 and is then sucked into the compressor 21. In the compressor 21, the refrigerant is compressed into high-temperature and high-pressure gas refrigerant. During the heating operation, the above cycle is continuously repeated.

Figure 2:
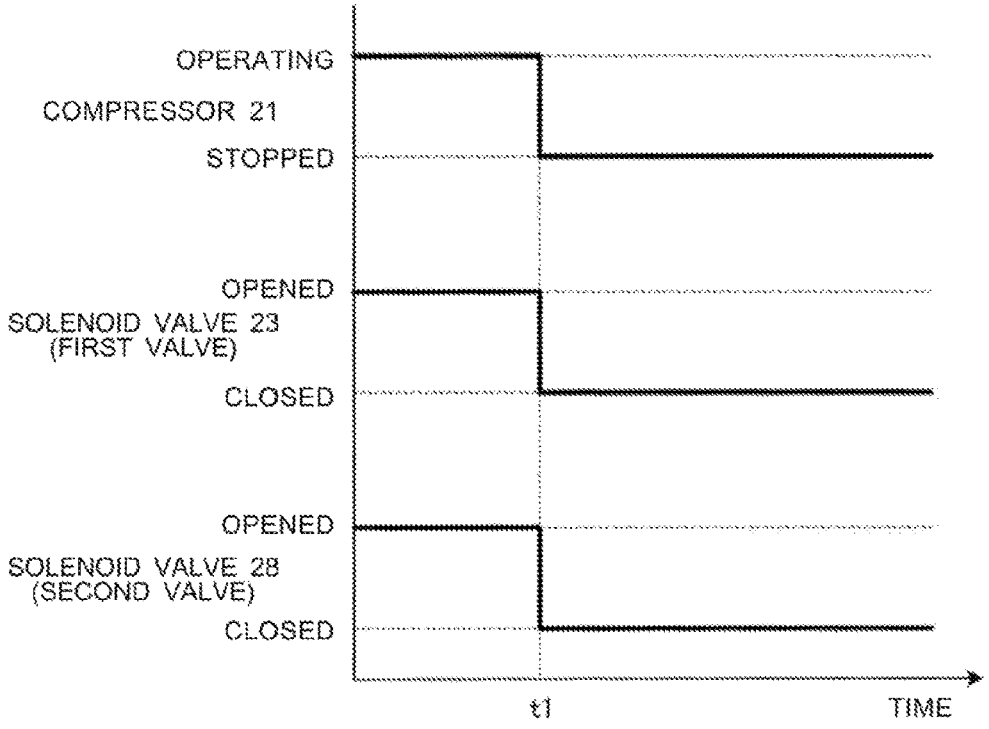
FIG. 2 is a timing diagram indicating a first example of the pattern of opening and closing of solenoid valves 23 and 28 before and after the time when a compressor 21 of the refrigeration cycle apparatus 1 according to embodiment 1 of the present invention is stopped.

FIG. 2 is a timing diagram indicating a first example of the pattern of opening and closing of solenoid valves 23 and 28 before and after the time when the compressor 21 of the refrigeration cycle apparatus 1 according to embodiment 1 is stopped. The horizontal axis of FIG. 2 indicates time. It is assumed that the cooling operation is performed before the compressor 21 is stopped. During the cooling operation, one of the solenoid valves 23 and 28 which is located downstream of the liquid receiver 26 in the flow of refrigerant is the solenoid valve 28, and the other solenoid valve, i.e., one of the solenoid valves 23 and 28 which is located upstream of the liquid receiver 26 in the flow of refrigerant is the solenoid valve 23. That is, during the cooling operation, the solenoid valve 28 is located downstream of the liquid receiver 26 and the solenoid valve 23 is located upstream of the liquid receiver 26. As described above, the solenoid valves 23 and 28 are both in the opened state while the compressor 21 is in operation.

When the operation of the refrigeration cycle apparatus 1 should be stopped or when leakage of refrigerant from the refrigeration cycle circuit 10 is detected, the controller 100 stops the compressor 21. As illustrated in FIG. 2, the controller 100 closes both the solenoid valves 23 and 28 at the same time as it stops the compressor 21 (time t1). That is, the solenoid valve 23 located upstream of the liquid receiver 26 and the solenoid valve 28 located downstream of the liquid receiver 26 are both closed at the same time as the compressor 21 is stopped. As a result, while the compressor 21 is in the stopped state, the liquid receiver 26 is cut off from the indoor heat exchanger 29 of the indoor unit 40 in the refrigeration cycle circuit 10. Generally, of the components of the refrigeration cycle circuit 10, the liquid receiver 26 contains the largest amount of refrigerant. Therefore, according to embodiment 1, even if refrigerant leaks from the indoor heat exchanger 29 while the compressor 21 is in the stopped, it is possible to prevent a large amount of refrigerant from the liquid receiver 26 from leaking from the indoor heat exchanger 29. Accordingly, the amount of refrigerant leakage from the indoor heat exchanger 29 can be reduced.

Furthermore, in embodiment 1, since the solenoid valve 23 is provided in the first section 11, the outdoor heat exchanger 24, as well as the liquid receiver 26, is cut off from the indoor heat exchanger 29 in the refrigeration cycle circuit 10. The outdoor heat exchanger 24 has a relatively large capacity, and thus may contain a large amount of refrigerant. Thus, according to embodiment 1, even if refrigerant leaks from the indoor heat exchanger 29 while the compressor 21 is in the stopped state, refrigerant from the outdoor heat exchanger 24, as well as the refrigerant from the liquid receiver 26, can be prevented from flowing into the indoor heat exchanger 29. Therefore, the amount of refrigerant leakage from the indoor heat exchanger 29 can be further reduced.

Although the above description is made with respect to the case where the cooling operation is performed before the compressor 21 is stopped, the same is true of the case where the heating operation is performed before the compressor 21 is stopped. That is, in the first example as indicated in FIG. 2, the solenoid valve 23 and the solenoid valve 28 are both closed at the same time as the compressor 21 is stopped regardless of whether the cooling operation or the heating operation is performed before the compressor 21 is stopped.

Figure 3:
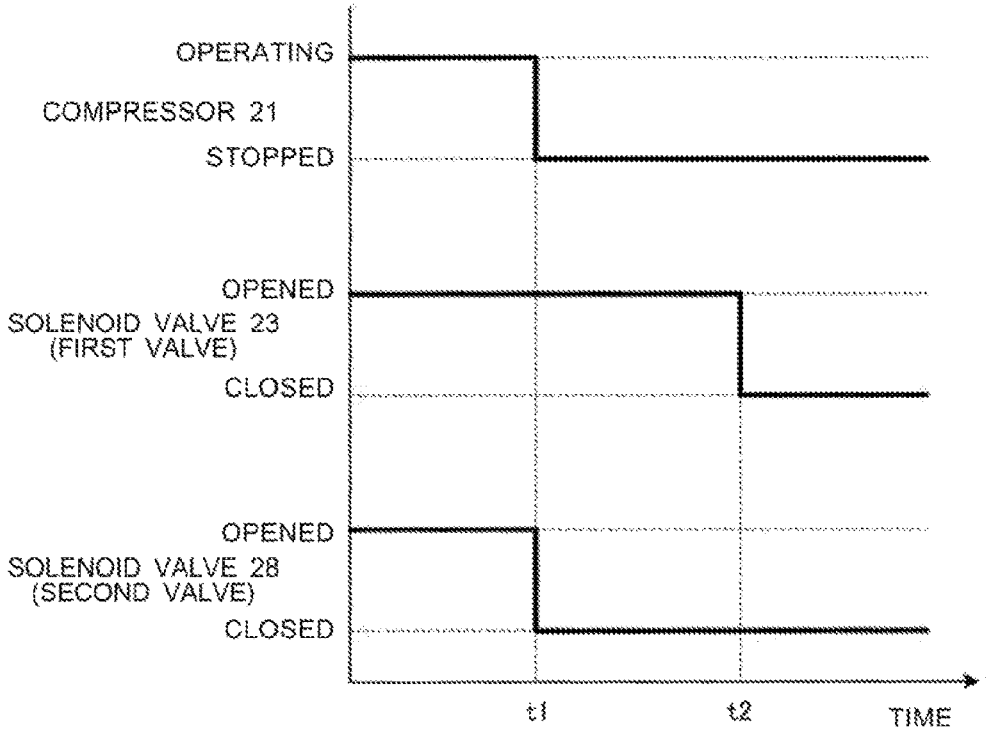
FIG. 3 is a timing diagram indicating a second example of the pattern of opening and closing of the solenoid valves 23 and 28 before and after the time when the compressor 21 of the refrigeration cycle apparatus 1 according to embodiment 1 of the present invention is stopped.

FIG. 3 is a timing diagram indicating a second example of the pattern of opening and closing of the solenoid valves 23 and 28 before and after the time when the compressor 21 of the refrigeration cycle apparatus 1 according to the present embodiment is stopped. The horizontal axis of FIG. 3 indicates time. This second example is applied to the case where the cooling operation is performed before the compressor 21 is stopped. During the cooling operation, the solenoid valve 28 is located downstream of the liquid receiver 26 and the solenoid valve 23 is located upstream of the liquid receiver 26.

As indicated in FIG. 3, the controller 100 closes the solenoid valve 28 at the same time as it stops the compressor 21 (time t1). The solenoid valve 23 is kept opened. That is, when the compressor 21 is stopped, the solenoid valve 28 located downstream of the liquid receiver 26 is closed at the same time as the compressor 21 is stopped, and the solenoid valve 23 located upstream of the liquid receiver 26 is kept opened. At this time, the controller 100 may also fully open the expansion valve 25 located upstream of the liquid receiver 26.

After a predetermined time elapses from the time when the compressor 21 is stopped, the controller 100 closes the solenoid valve 23 (time t2).

Even after the compressor 21 is stopped, the refrigerant continues to flow in the refrigeration cycle circuit 10 to some extent by inertia. Therefore, even after the compressor 21 is stopped, the refrigerant in the indoor unit 40 flows through the extension pipe 51, the refrigerant flow switching device 22, the stopped compressor 21, the solenoid valve 23 being in the opened state, the outdoor heat exchanger 24 and the expansion valve 25, and then flows into the liquid receiver 26. By contrast, the solenoid valve 28 located downstream of the liquid receiver 26 is closed, and refrigerant entering the liquid receiver 26 is thus prevented from flowing toward the indoor heat exchanger 29. Therefore, after the compressor 21 is stopped, the refrigerant in the refrigeration cycle circuit 10 is gradually collected in the liquid receiver 26.

The solenoid valve 23 located upstream of the liquid receiver 26 is closed after the refrigerant in the refrigeration cycle circuit 10 is collected in the liquid receiver 26. As a result, the liquid receiver 26 contains a larger amount of refrigerant, and in this state, the liquid receiver 26 is cut off from the indoor heat exchanger 29. Therefore, according to embodiment 1, even if refrigerant leaks from the indoor heat exchanger 29 while the compressor 21 is in the stopped state, it is possible to prevent the large amount of refrigerant from the liquid receiver 26 from leaking from the indoor heat exchanger 29. Therefore, the amount of refrigerant leakage from the indoor heat exchanger 29 can be further reduced.

The inventors of the present invention carried out experiment regarding a refrigeration cycle circuit provided with a liquid reservoir. In this experiment, it was measured how the amount of refrigerant in the liquid reservoir varied in the case where a compressor was stopped and a valve downstream of the liquid reservoir was closed. According the result of the experiment, the amount of refrigerant in the liquid reservoir slightly increased for approximately 90 seconds from the time when the compressor was stopped, and then started to rapidly vary when approximately 90 seconds elapsed from the time when the compressor was stopped. Then, the amount of refrigerant in the liquid reservoir monotonically increased while an increasing rate of the amount of refrigerant gradually decreased. When approximately 300 seconds elapsed from the time when the compressor was stopped, approximately 80% of the entire amount of refrigerant in the refrigeration cycle circuit was collected in the liquid reservoir. Therefore, it is preferable that the time period from the time when the compressor 21 is stopped to the time when the solenoid valve 23 is closed (that is, time from time t1 to time t2 as indicated in FIG. 3) be approximately 300 seconds or more.

In embodiment 1, since the solenoid valve 23 is provided in the first section 11, when the solenoid valve 23 is closed, the outdoor heat exchanger 24, as well as the liquid receiver 26, is cut off from the indoor heat exchanger 29. Thereby, the outdoor heat exchanger 24 serves as a reservoir to retain the refrigerant, as well as the liquid receiver 26. Therefore, in part of the refrigeration cycle circuit 10 which is cut off from the indoor heat exchanger 29, a larger amount of refrigerant can be stored.

Figure 4:
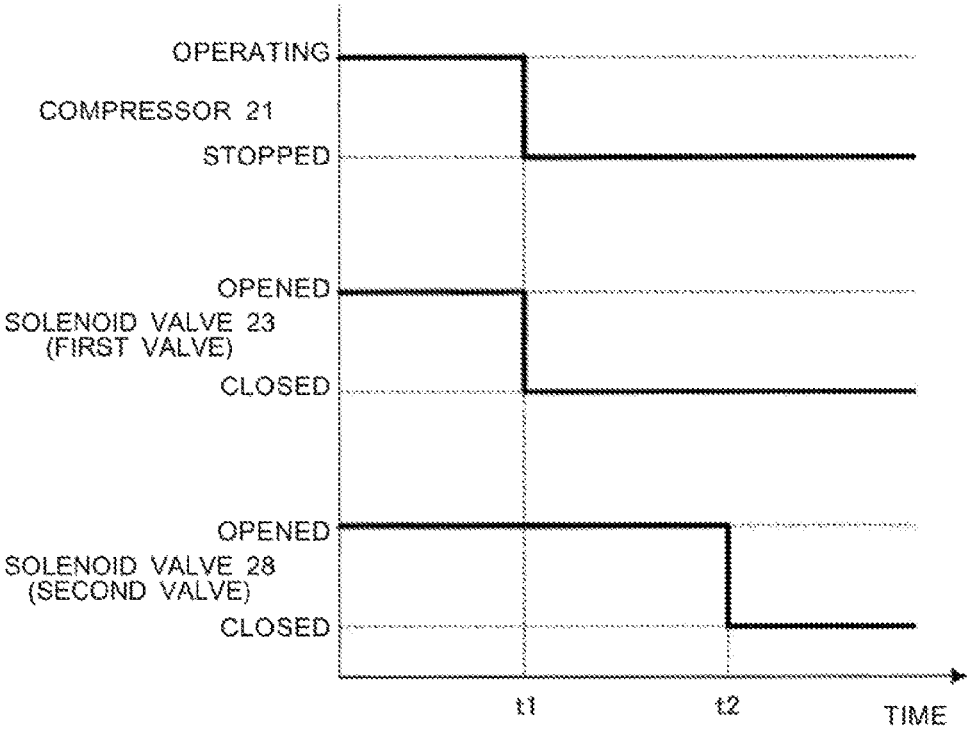
FIG. 4 is a timing diagram indicating a third example of the pattern of opening and closing of the solenoid valves 23 and 28 before and after the time when the compressor 21 of the refrigeration cycle apparatus 1 according to embodiment 1 of the present invention is stopped.

FIG. 4 is a timing diagram indicating a third example of the pattern of opening and closing of the solenoid valves 23 and 28 before and after the time when the compressor 21 of the refrigeration cycle apparatus 1 according to embodiment 1 is stopped. The horizontal axis of FIG. 4 indicates time. This third example is applied to the case where the heating operation is performed before the compressor 21 is stopped. During the heating operation, the solenoid valve 23 is located downstream of the liquid receiver 26, and the solenoid valve 28 is located upstream of the liquid receiver 26.

As illustrated in FIG. 4, the controller 100 closes the solenoid valve 23 as the same time as it stops the compressor 21 (time t1). The solenoid valve 28 is kept opened. That is, when the compressor 21 is stopped, the solenoid valve 23 located downstream of the liquid receiver 26 is closed at the same time as the compressor 21 is stopped, and the solenoid valve 28 located upstream of the liquid receiver 26 is kept opened. At this time, the controller 100 may also fully open the expansion valve 27 located upstream of the liquid receiver 26.

Then, when a predetermined time period elapses from the time when the compressor 21 is stopped, the controller 100 closes the solenoid valve 28 (time t2). For the above reason, it is preferable that the time period from the time when the compressor 21 is stopped to the time when the solenoid valve 28 is closed (time from the time t1 to the time t2 as indicated in FIG. 4) be approximately 300 or more seconds.

As described above, the refrigeration cycle apparatus 1 according to embodiment 1 includes: the refrigeration cycle circuit 10 including the compressor 21, the outdoor heat exchanger 24 and the indoor heat exchanger 29; the liquid receiver 26 provided in the second section 12 in the refrigeration cycle circuit 10; the first valve (for example, the solenoid valve 23) which is provided in the first section 11, and which is a solenoid valve or a motor valve; and the second valve (for example, the solenoid valve 28) which is provided between the liquid receiver 26 and the indoor heat exchanger 29 in the second section 12, and which is an electronic expansion valve, a solenoid valve, or a motor valve. It should be noted that the first section 11 extends between the outdoor heat exchanger 24 and the indoor heat exchanger 29 through the compressor 21, and the second section 12 extends between the outdoor heat exchanger 24 and the indoor heat exchanger 29 without extending through the compressor 21.

In the above configuration, the liquid receiver 26 can be cut off by the solenoid valves 23 and 28 from the indoor heat exchanger 29 in the refrigeration cycle circuit 10 after the stop of the compressor 21. Therefore, even if refrigerant leaks from the indoor heat exchanger 29 while the compressor 21 is in the stopped state, it is possible to reduce the amount of refrigerant leakage through the indoor heat exchanger 29. Thereby, it is also possible to reduce the amount of refrigerant leaking into a room while the compressor 21 is in the stopped state. Thus, for example, even in the case where a flammable refrigerant is used, it is possible to reduce the degree of formation of a flammable area in the room.

Furthermore, in the above configuration, since the solenoid valve 23 is provided in the first section 11, the outdoor heat exchanger 24, as well as the liquid receiver 26, can be cut off from the indoor heat exchanger 29. Therefore, even if refrigerant leaks from the indoor heat exchanger 29 while the compressor 21 is in the stopped state, it is possible to further reduce the amount of refrigerant leakage from the indoor heat exchanger 29. Furthermore, in the configuration, since the refrigerant can be stored not only in the liquid receiver 26, but in the indoor heat exchanger 29, it is possible to make the liquid receiver 26 smaller while maintaining the refrigerant storage capacity.

The refrigeration cycle apparatus 1 according to embodiment 1 further includes the controller 100 to control the solenoid valves 23 and 28. When the compressor 21 is stopped, the controller 100 closes (for example, fully closes) one of the solenoid valves 23 and 28 that is located downstream of the liquid receiver 26 in the flow of refrigerant (for example, the solenoid valve 28 in the case where the cooling operation is performed before the stop of the compressor 21, and the solenoid valve 23 in the case where the heating operation is performed before the stop of the compressor 21). Also, when the compressor 21 is stopped or after a predetermined time period elapses from the time when the compressor 21 is stopped, the controller 100 closes (for example, fully closes) the other of the solenoid valves 23 and 28 (for example, the solenoid valve 23 in the case where the cooling operation is performed before the stop of the compressor 21, and the solenoid valve 28 in the case where the heating operation is performed before the stop of the compressor 21).

In the above configuration, when the compressor 21 is stopped or after a predetermined time period elapses from the time when the compressor 21 is stopped, the liquid receiver 26 and the outdoor heat exchanger 24 can be cut off from the indoor heat exchanger 29 in the refrigeration cycle circuit 10. Thus, even if refrigerant leaks from the indoor heat exchanger 29 while the compressor 21 is in the stopped state, it is possible to reduce the amount of refrigerant leakage from the indoor heat exchanger 29.

Furthermore, when the compressor 21 is stopped, the valve located downstream of the liquid receiver 26 is closed, whereas the valve located upstream of the liquid receiver 26 is kept opened for a predetermined time period. Thereby, refrigerant flowing by inertia can be collected in the liquid receiver 26 and the outdoor heat exchanger 24. As a result, the liquid receiver 26 and the outdoor heat exchanger 24 store a larger amount of refrigerant before they are cut off from the indoor heat exchanger 29. Therefore, even if refrigerant leaks from the indoor heat exchanger 29 while the compressor 21 is in the stopped state, it is possible to further reduce the amount of refrigerant leakage from the indoor heat exchanger 29.

The refrigeration cycle apparatus 1 according to embodiment 1 further includes the outdoor unit 30 which houses the outdoor heat exchanger 24, the liquid receiver 26, the first valve (for example, the solenoid valve 23) and the second valve (for example, the solenoid valve 28), and the indoor unit 40 which houses the indoor heat exchanger 29.

In the above configuration, after the compressor 21 is stopped, the liquid receiver 26 and the outdoor heat exchanger 24 can be cut off the indoor unit 40 in the refrigeration cycle circuit 10. Therefore, even if refrigerant leaks from the indoor unit 40 while the compressor 21 is in the stopped state, the amount of refrigerant leakage from the indoor unit 40 can be reduced.

Embodiment 2

Figure 5:
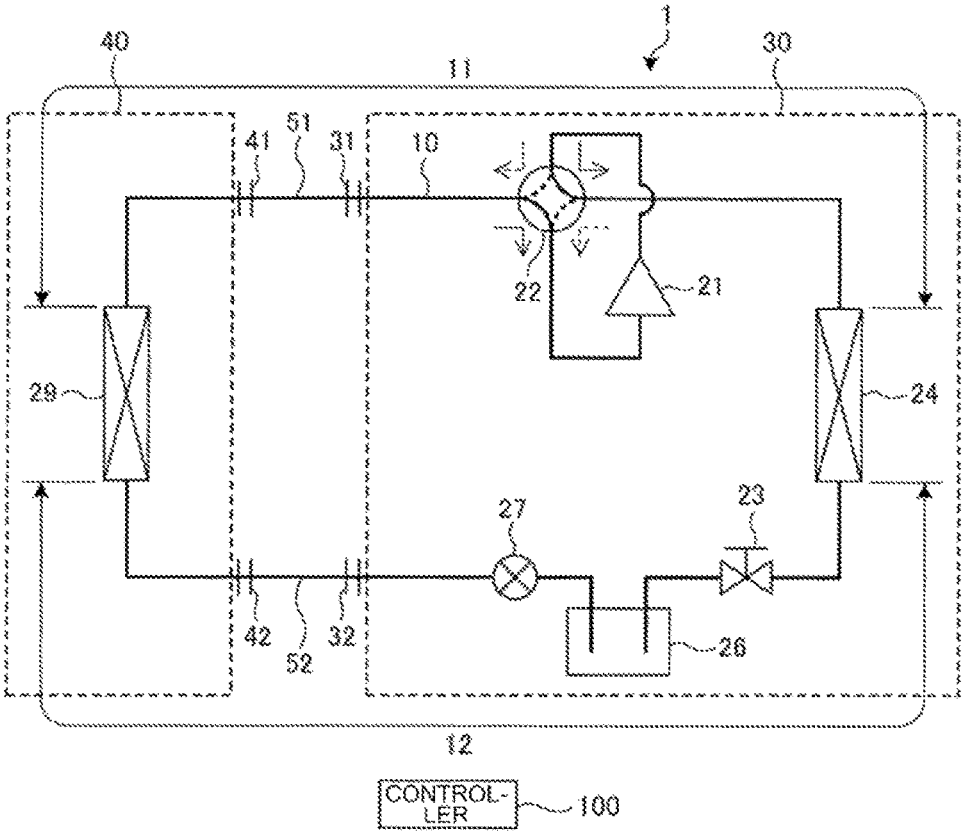
FIG. 5 is a refrigerant circuit diagram illustrating a schematic configuration of the refrigeration cycle apparatus 1 according to embodiment 2 of the present invention.

A refrigeration cycle apparatus according to embodiment 2 of the present invention will be described. FIG. 5 is a refrigerant circuit diagram illustrating a schematic configuration of the refrigeration cycle apparatus 1 according to the present embodiment. It should be noted that components which have the same functions and advantages as those in embodiment 1 will be denoted by the same reference signs, and their descriptions will thus be omitted.

As illustrated in FIG. 5, in the refrigeration cycle apparatus 1 according to the embodiment 2, neither the solenoid valve 28 nor the expansion valve 25 is provided. In this regard, the refrigeration cycle apparatus 1 according to the embodiment 2 is different from the refrigeration cycle apparatus 1 according to embodiment 1. In embodiment 2, the solenoid valve 23 is provided in the second section 12 and between the outdoor heat exchanger 24 and the liquid receiver 26. The solenoid valve 23 may, however, be provided in the first section 11 as in embodiment 1. In embodiment 2, the solenoid valve 23 serves as the first valve, and the expansion valve 27 serves as the second valve.

In embodiment 2, the first valve and the second valve are controlled at the same timings as those of any of the first example as indicated in FIG. 2, the second example as indicated in FIG. 3 and the third example as indicated in FIG. 4. That is, in embodiment 2, opening and closing operations of the solenoid valve 23 (the first valve) and the expansion valve 27 (the second valve) at the time when the compressor 21 is stopped and before and after the time are the same as or similar to those of the solenoid valve 23 (the first valve) and the solenoid valve 28 (the second valve), respectively, in any of the first to the third examples of embodiment 1.

As described above, the refrigeration cycle apparatus 1 according to embodiment 1 includes: the refrigeration cycle circuit 10 including the compressor 21, the outdoor heat exchanger 24 and the indoor heat exchanger 29; the liquid receiver 26 in the second section 12 in the refrigeration cycle circuit 10, the second section 12 being a section extending between the outdoor heat exchanger 24 and the indoor heat exchanger 29 without extending through the compressor 21; the first valve (for example, the solenoid valve 23) provided in the second section 12 and between the outdoor heat exchanger 24 and the liquid receiver 26 or provided in the first section 11 in the refrigeration cycle circuit 10, the first valve being an electronic expansion valve, a solenoid valve or a motor valve, the first section being a section extending between the outdoor heat exchanger 24 and the indoor heat exchanger 29 through the compressor 21; the second valve (e.g., the expansion valve 27) provided in the second section 12 and between the liquid receiver 26 and the indoor heat exchanger 29, the second valve being an electronic expansion valve, a solenoid valve or a motor valve; and the controller 100 configured to control the compressor 21, the solenoid valve 23 and the expansion valve 27. When the compressor 21 is stopped, the controller 100 closes (for example, fully closes) one of the solenoid valve 23 and the expansion valve 27 which is located downstream of the liquid receiver 26 in the flow of refrigerant (for example, the expansion valve 27 in the case where the cooling operation is performed before the stop of the compressor 21, and the solenoid valve 23 in the case where the heating operation is performed before the stop of the compressor 21). Also, when the compressor 21 is stopped or after a predetermined time period elapses from the time when the compressor 21 is stopped, the controller 100 also closes (for example, fully closes) the other of the solenoid valve 23 and the expansion valve 27 (for example, the solenoid valve 23 in the case where the cooling operation is performed before the stop of the compressor 21, and the expansion valve 27 in the case where the heating operation is performed before the stop of the compressor 21).

In the above configuration, when the compressor 21 is stopped or after a predetermined time period elapses from the time when the compressor 21 is stopped, the liquid receiver 26 can be cut off from the indoor heat exchanger 29 in the refrigeration cycle circuit 10. Therefore, even if refrigerant leaks form the indoor heat exchanger 29 while the compressor 21 is in the stopped state, the amount of refrigerant leakage from the indoor heat exchanger 29 can be reduced. Therefore, it is possible to reduce the amount of refrigerant which leaks into a room while the compressor 21 is in the stopped state. Thus, for example, even if a flammable refrigerant is used, it is also possible to reduce the degree of formation of a flammable area in the room.

When the compressor 21 is stopped, the valve located downstream of the liquid receiver 26 is closed, and the valve located upstream of the liquid receiver 26 is kept opened for a predetermined time period, whereby refrigerant flowing by inertia can be collected in the liquid receiver 26. Therefore, a larger amount of refrigerant is stored in the liquid receiver 26 before the liquid receiver 26 is cut off from the indoor heat exchanger 29. Thus, even if refrigerant leaks from the indoor heat exchanger 29 while the compressor 21 is in the stopped state, it is possible to further reduce the amount of refrigerant leakage from the indoor heat exchanger 29.

Embodiment 3

Figure 6:
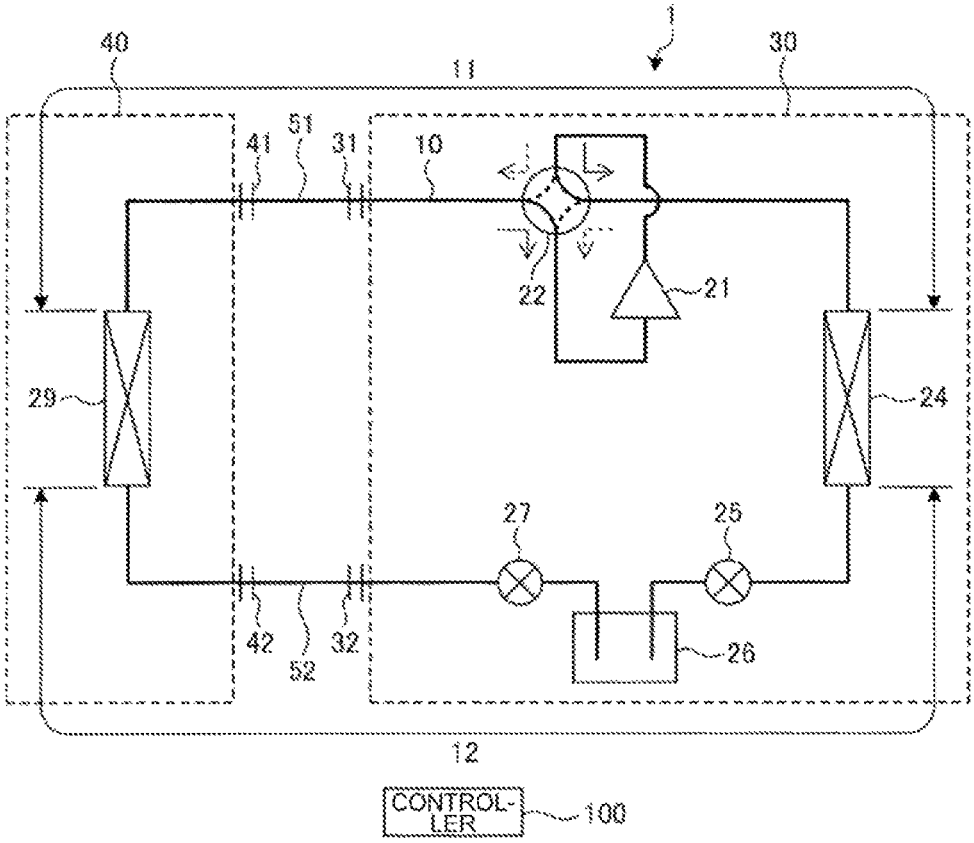
FIG. 6 is a refrigerant circuit diagram illustrating a schematic configuration of the refrigeration cycle apparatus 1 according to embodiment 3 of the present invention.

A refrigeration cycle apparatus according to embodiment 3 of the present invention will be described. FIG. 6 is a refrigerant circuit diagram illustrating a schematic configuration of the refrigeration cycle apparatus 1 according to the present embodiment. It should be noted that components which have the same functions and advantages as those in embodiment 1 or 2 will be denoted by the same reference signs, and their descriptions will thus omitted.

As illustrated in FIG. 6, in the refrigeration cycle apparatus 1 according to embodiment 3, the expansion valve 25 is used instead of the solenoid valve 23. In this regard, the refrigeration cycle apparatus 1 according to embodiment 3 is different from the refrigeration cycle apparatus 1 according to embodiment 2. The expansion valve 25 is provided in the second section 12 and between the outdoor heat exchanger 24 and the liquid receiver 26. In embodiment 3, the expansion valve 25 serves as the first valve, and the expansion valve 27 serves as the second valve. Each of the expansion valves 25 and 27 is an electronic expansion valve whose opening degree is adjustable by the controller 100.

In embodiment 3, the first valve and the second valve are controlled at the same timings as those of any one of the first example indicated in FIG. 2, the second example indicated in FIG. 3 and the third example indicated in FIG. 4. To be more specific, in embodiment 3, the opening and closing timings of the expansion valve 25 (the first valve) and the expansion valve 27 (the second valve) at the time at which the compressor 21 is stopped and before and after the time are the same as those of the solenoid valve 23 (the first valve) and the solenoid valve 28 (the second valve), respectively, in any one of the first to the third examples of embodiment 1. In embodiment 3, the same advantages as in second embodiment 2 can be obtained.

The present invention is not limited to the above embodiments, and can be variously modified.

For example, with respect to each of the above embodiments, although the air-conditioning device is described above as an example of the refrigeration cycle apparatus, the present invention can be applied to other types of refrigeration cycle apparatuses such as a water heater.

Embodiments 1 to 3 as described above can be combined when they are put to practical use.

REFERENCE SIGNS LIST

1 refrigeration cycle apparatus 10 refrigeration cycle circuit 11 first section 12 second section 21 compressor 22 refrigerant flow switching device 23 solenoid valve 24 outdoor heat exchanger 25 expansion valve 26 liquid receiver 27 expansion valve 28 solenoid valve 29 indoor heat exchanger 30 outdoor unit 31, 32 joint 40 indoor unit 41, 42 joint 51, 52 extension pipe 100 controller

The invention claimed is:

1. A refrigeration cycle apparatus comprising:

a refrigeration cycle circuit including a compressor, an outdoor heat exchanger and an indoor heat exchanger;

a liquid receiver provided in a second section of a plurality of sections located in the refrigeration cycle circuit, the plurality of sections including a first section and the second section, the first section being a section extending between the outdoor heat exchanger and the indoor heat exchanger through the compressor, the second section being a section extending between the outdoor heat exchanger and the indoor heat exchanger without extending through the compressor;

a first valve provided in the second section and between the outdoor heat exchanger and the liquid receiver or provided in the first section, the first valve being an electronic expansion valve, a solenoid valve or a motor valve;

a second valve provided in the second section and between the liquid receiver and the indoor heat exchanger, the second valve being an electronic expansion valve, a solenoid valve or a motor valve; and a controller configured to control the compressor, the first valve, and the second valve, wherein during a first operation mode when the refrigerant flows through the refrigeration cycle circuit in a first flow direction, the first valve is located downstream of the liquid receiver in a flow of refrigerant and the second valve is located upstream of the liquid receiver in a flow of refrigerant, during a second operation mode when the refrigerant flows through the refrigeration cycle circuit in a second flow direction different from the first direction, the first valve is located upstream of the liquid receiver in a flow of refrigerant and the second valve is located downstream of the liquid receiver in a flow of refrigerant, and the controller is configured to during the first operation mode, close the first valve when the compressor is stopped, and close the second valve after a predetermined time period elapses from a time when the compressor is stopped, and during the second operation mode, close the second valve when the compressor is stopped, and close the first valve after a predetermined time period elapses from time when the compressor is stopped.

2. The refrigeration cycle apparatus of claim 1, wherein the refrigeration cycle circuit further includes a refrigerant flow switcher configured to set the flow of the refrigerant to the first flow direction in the first operation mode and the second flow direction in the second operation mode.

3. The refrigeration cycle apparatus of claim 1, wherein the refrigeration cycle apparatus is capable of switching operation between the first operation mode and the second operation mode.

4. The refrigeration cycle apparatus of claim 1, wherein the first operation mode is a heating operation, and the second operation mode is a cooling operation.

* * * * *